United States Patent [19]

Bedell

[11] Patent Number: 4,572,482

[45] Date of Patent: Feb. 25, 1986

[54] FLUID-COOLED METALLURGICAL TUYERE

[75] Inventor: Edward L. Bedell, Louisville, Ky.

[73] Assignee: Corcliff Corporation, Boston, Mass.

[21] Appl. No.: 673,083

[22] Filed: Nov. 19, 1984

[51] Int. Cl.[4] ..... C21B 7/16

[52] U.S. Cl. ..... 266/47; 266/218; 266/270

[58] Field of Search ..... 266/46, 47, 218, 265, 266/266, 270

[56] References Cited

U.S. PATENT DOCUMENTS

| | | | |
|---|---|---|---|
| 394,384 | 12/1888 | McCarthy | 266/266 |
| 746,238 | 12/1903 | Baggaley | 266/218 |
| 870,925 | 11/1907 | Baggaley | 266/218 |
| 942,346 | 12/1909 | Peirce et al. | 266/218 |
| 3,395,910 | 12/1965 | Holmes | 266/270 |
| 3,598,382 | 8/1971 | Ostrewaki | 266/193 |
| 3,614,083 | 10/1971 | Holmes | 266/270 |
| 3,627,510 | 12/1971 | Vogt et al. | 75/76 |
| 3,794,308 | 2/1974 | Ponghis et al. | 266/270 |

FOREIGN PATENT DOCUMENTS

| | | | |
|---|---|---|---|
| 1006695 | 3/1977 | Canada . | |
| 48-27166 | 8/1973 | Japan . | |
| 49-18683 | 5/1974 | Japan | 266/270 |
| 1072121 | 6/1967 | United Kingdom . | |
| 2047860A | 12/1980 | United Kingdom . | |

OTHER PUBLICATIONS

Materials Engineering, Jul. 1970, p. 49.

*Primary Examiner*—L. Dewayne Rutledge
*Assistant Examiner*—Robert L. McDowell
*Attorney, Agent, or Firm*—B. R. Turner

[57] ABSTRACT

A novel tuyere assembly for a metallurgical furnace is disclosed having a tuyere pipe formed of extremely high thermal conductivity and heat diffusivity materials, wherein a heat sink and a water cooled chamber, positioned exteriorly of the metallurgical furnace, extract heat from the tuyere tip through efficient heat conductivity along the tuyere pipe, so as to overcome problems of knurdle size control and tuyere pipe burnback.

20 Claims, 8 Drawing Figures

FLUID-COOLED METALLURGICAL TUYERE

BACKGROUND OF THE INVENTION

Metallurgical tuyeres are utilized in pyro-metallurgical processes for injecting a gas, such as air, below the surface of a molten metal bath. The molten bath may be ferrous, such as in steel making processes, or non-ferrous, such as in copper converting processes.

A major problem which has plagued the metallurgical industry for years, has been the erosion/corrosion and general deterioration of the tuyere pipes and surrounding refractory which is experienced within a molten bath during the blowing process. The chemical energy generated at the tuyere tip appears to create a thermal and chemical environment which results in a situation wherein the tuyere rate of wear is markedly greater than the refractory brick rate of wear. Such situation results in a mechanism of failure that is mechanically related, rather than corrosion/erosion related, as previously envisioned in the art.

As pointed out in U.S. Pat. No. 3,627,510, during a copper converting operation, molten copper has a tendency to freeze to a greater or less extent over the end of and up into the tuyeres, thereby reducing the cross-sectional area of the tuyeres and the gas flow through the tuyere pipes. Such build-up or accretion of solidified copper matte is also known as a "knurdle." The formation of a knurdle on the tuyere nozzle and the effects thereof on the surrounding refractory brick upon its removal, has been considered to be undesirable in the industry.

Various attempts have been made in the past to eliminate the formation and effects of knurdles, including the use of water-cooled tuyeres, such as shown in U.S. Pat. Nos. 746,238 and 870,925, and Japanese Patent Application No. 48-27166. Generally, the tuyere pipe has either been formed of cast iron or plain carbon steel, as set forth in U.S. Pat. No. 942,346, or stainless steel, as set forth in U.S. Pat. No. 3,627,510, although the U.S. Pat. No. 870,925 suggested the use of a seamless brass tuyere pipe. Due to the relatively low thermal conductivity and heat diffusivity of such materials, the cooling of base portions of such tuyere pipes did not function to maintain a controlled temperature at the tip of the nozzle communicating with the molten bath. Further, when water cooling was attempted along the longitudinal extent of the nozzle, the tuyere pipe was protected only until such time as the surrounding refractory deteriorated, which then permitted the ultimate consumption of the tuyere pipe per se, and the catastropic release of water into the molten metal bath.

In addition, the use of water cooled copper tuyeres and water cooled furnace cooling plates made of copper were known in the art as shown by United Kingdom Pat. Nos. 1,072,121 and 2,047,860 A and U.S. Pat. No. 3,598,382. Here again, however, the required cooling was provided by means of water which circulated the full longitudinal extent of the tuyeres and cooling plates, which as previously mentioned, produces a safety hazard due to the deleterious effects produced upon water leakage. Canadian Pat. No. 1,006,695 relates to cooling devices for protecting refractory linings of furnaces wherein solid probes are positioned within the refractory and are water cooled externally thereof. However, the Canadian patent is not concerned with the deleterious effects products at the end of a hollow tuyere pipe during the blowing of gas or oxygen enriched air into a molten metal bath. In basic oxygen steel making, oxygen lances, formed of wrought tubular sections, are provided with water-cooled silver copper casings to dissipate the heat generated during the blowing of the surface of the melt, as disclosed on page 49 of the July, 1970, issue of *Materials Engineering*.

As shown in U.S. Pat. No. 3,395,910, refractory sheaths consisting of refractory cement or blocks have been utilized to protect the tuyere pipes from the molten metal in which they are submerged, whereas U.S. Pat. No. 3,627,510 suggests that the tuyere pipe may be coated with a refractory material to insure a good fit and prevent fusion of the pipes during service.

The present invention overcomes the problems of knurdle size control, tuyere pipe burn-back, and adjacent refractory deterioration, by utilizing external fluid cooling in conjunction with proper thermal conductivity and heat diffusivity design within a tuyere pipe. A range of control of heat extraction is provided so as to match the process temperature variability of the molten bath adjacent to the tuyere nozzle.

SUMMARY OF THE INVENTION

In its simplest form, the present invention sets forth a metallurgical tuyere wherein the tuyere body is liquid cooled, and the tuyere pipe, which connects with the liquid-cooled tuyere body, is formed of a material having high heat diffusivity and high thermal conductivity, such as that exhibited by silver copper and copper silver alloys. A heat-insulating coating or barrier may be applied on the outside diameter of the tuyere pipe to prevent significant heat transfer from the surrounding tuyere block to the tuyere pipe. Thus, by controlling the cooling of the tuyere nozzle, by means of the liquid cooling within the tuyere body which functions through the high heat diffusivity and high thermal conductivity properties employed within the tuyere pipe, not only is it possible to control the rate of burn-back of the tuyere pipe, so as to substantially conform with the rate of wear of the surrounding refractory, but also the deleterious effects of knurdle formation may be minimized.

Accordingly, it has been an object of the present invention to provide an improved metallurgical tuyere having external liquid cooling associated with a tuyere pipe having relatively high heat diffusivity and thermal conductivity, so as to provide sufficient heat extraction potential over a range of control to compensate for variability in the temperature of the bath adjacent the tuyere nozzle during the blowing process.

DESCRIPTION OF THE PREFERRED EMBODIMENTS

Figure 1:
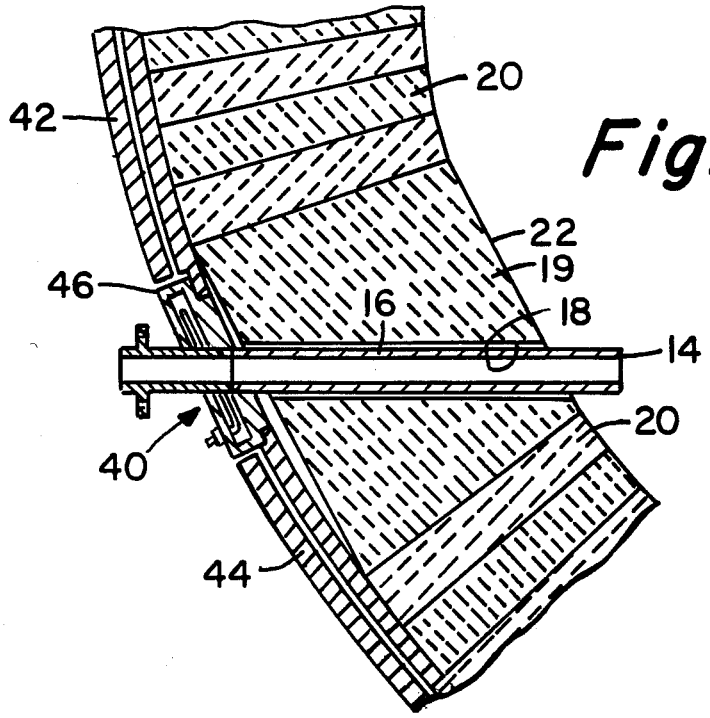
FIG. 1 is a somewhat schematic fragmental elevational view in section of a metallurgical tuyere, embodying the present invention, mounted in a copper converter.

In order to better understand the principle of operation and the theory behind the tuyere of the present invention, it is not only necessary to explore actual tuyere operations, but also misconceptions surrounding such operations which have been fostered in the past. As disclosed in U.S. Pat. No. 870,925, it has been the belief of the industry that the destruction of the refractory lining in a converter vessel at the tuyere nozzle, was due to increased heat in the matte and due to the mechanical agitation adjacent the nozzle, which was aggravated by the erosion of the adjacent lining upon the mechanical removal of the formed knurdle by operations known as tuyere punching and reaming. However, it is my opinion that chemical energy generated at the tuyere tip appears to create a thermal and chemical environment, which results in a situation wherein the tuyere rate of wear is markedly greater than the surrounding refractory brick rate of wear.

Thus, the resulting mechanism of failure is more mechanically related, and not corrosion/erosion related, as previously thought. That is, it is apparent to me that the mechanism producing the gross mechanical damage about tuyere nozzles is caused by the tuyere pipe burn-back, while the refractory failure thereabout, resulting from the mechanical clearing or punching of the knurdle, is the observed effect, but not the basic cause. Thus, it is the tuyere pipe burn-back, resulting from the alloying and consumption of the tuyere pipe by sulfur, oxygen, etc. within the molten bath, which causes the resulting refractory deterioration upon the punching or mechanical removal of the knurdle formed in the tuyere port, which port was formally occupied by the tuyere pipe. Accordingly, by controlling the temperature of the tuyere pipe through proper heat extraction, tuyere pipe burn-back can be controlled to correlate with the normal wear of the refractory brick, and thus knurdle formation and knurdle cleaning processes can be maintained within acceptable parameters.

The formation of a knurdle on a tuyere pipe is the result of the thermal energy balance of the molten bath at the tuyere tip and adjacent the basic refractory within a converter or the like surrounding such tip. The composition of the knurdle is dependent upon the alloy and slag being blown in during the operation. That is, during the blow, the size and shape, as well as the composition of the knurdle, are dependent upon the total energy balance at the tuyere tip, which balance includes the chemical energy in the melt system, the tuyere axial heat flux, the refractory gradient heat flux, and the inter-tuyere heat fluxes due to inter-tuyere spacing. In accordance with the present invention, the tuyere pipe is formed of a material having high heat diffusivity and high thermal conductivity, so as to enhance the tuyere axial heat flux capabilities and remove deleterious thermal energy transmitted to the tuyere tip from the molten metal bath. An insulating layer or refractory coating, such as flame-sprayed alumina, applied to the outside surface of the tuyere pipe, materially reduces the refractory gradient heat flux transferred to the tuyere pipe.

The size and the shape of the knurdle, which freezes upon the cooled tuyere tip, is influenced by the adjacent molten bath temperature and the blowing practice employed. Although typical knurdle formations are shown in FIGS. 4–7, due to the gross temperature swings of the molten bath temperature resulting from conventional process steps, such as composition of alloy additions, amount of alloy additions, blowing rate, oxygen content, cooling gas content, and bath depth, the resulting knurdles vary in size, shape and composition throughout the blowing process.

When excessive energy is applied in a pyro-metallurgical process and the cooling capacity of the tuyere is inadequate, high heat fluxes are generated which prevent the formation of a solid knurdle form. However, such condition results in tuyere pipe burn-back, due to the high heat fluxes and alloying damage to the pipe.

Figure 5:
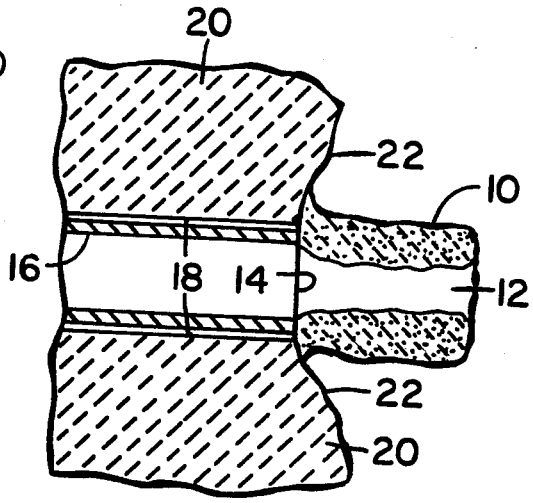
FIG. 5 is a somewhat schematic fragmental elevational view in section of a nozzle portion of a tuyere pipe showing the formation of an ideal knurdle form, in a situation wherein the burn-back and refractory wear are substantially equal.

FIG. 5 represents a condition in a pyro-metallurgical process wherein the blowing practice temperature and bath composition and the cooling capacity of the tuyere are such so as to form a knurdle 10 having an open passage 12, on the tip 14 of tuyere pipe 16, positioned within tuyere port 18, formed in the surrounding basic refractory 20. The knurdle, which is open by passage 12 and accordingly free blowing, results in displacing the developing chemical heat flux in the molten bath away from the inner surface 22 of the basic refractory 20 adjacent tuyere tip 14, thus minimizing the developing slag corrosion/erosion potential of the refractory.

Figure 8:
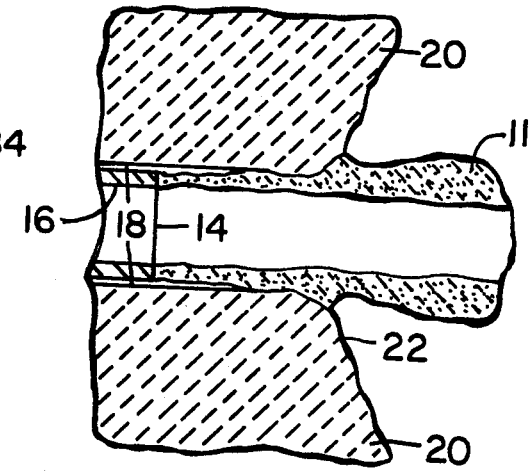
FIG. 8 is a somewhat schematic fragmental elevational view in section of a nozzle portion of a tuyere pipe showing the formation of an extended knurdle, in a situation wherein the pipe burn-back is substantially greater than the refractory wear.
Figure 6:
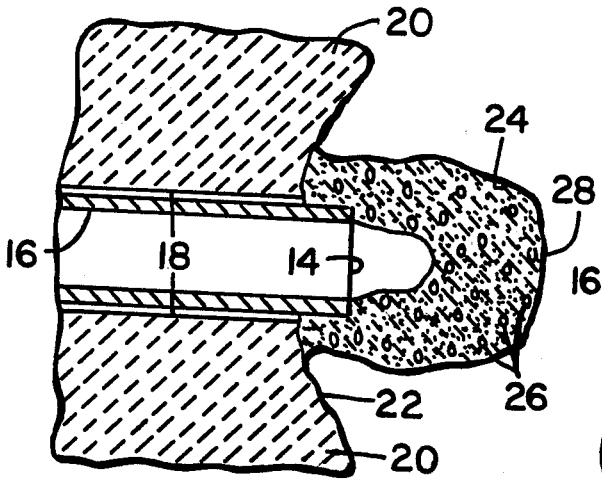
FIG. 6 is a somewhat schematic fragmental elevational view in section of a nozzle portion of a tuyere pipe showing the formation of a porous knurdle, in a situation wherein the refractory wear is substantially greater than the pipe burn-back.
Figure 7:
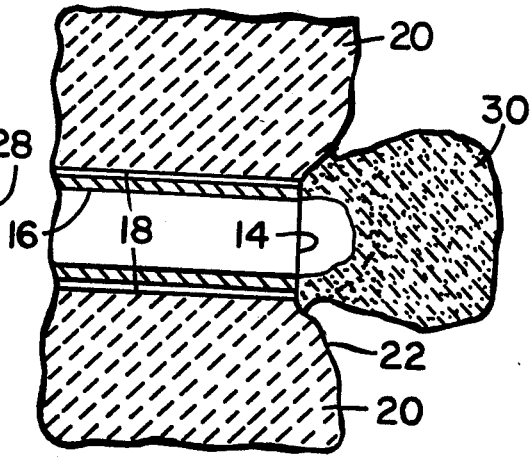
FIG. 7 is a somewhat schematic fragmental elevational view in section of a nozzle portion of a tuyere pipe showing the formation of knurdle closing off the tuyere pipe, in a situation wherein the pipe burn-back and refractory wear are substantially equal.

Excessive knurdle growth which impedes the blowing process and results in excessive refractory damage is shown in both FIG. 6 and FIG. 7. Although shown with respect to a pipe which has not been burnt back, it will be appreciated that such knurdles may also be formed on a burnt back pipe such as shown in FIG. 8. A porous refractory knurdle 24 having a plurality of porous openings 26, is shown virtually closing off the tuyere pipe 16 in FIG. 6. The porous knurdle 24, of FIG. 6, results from a condition wherein the temperature of the molten bath and the chemical energy in the metal system are at a lower state than that producing the ideal knurdle 10 of FIG. 5. In view of the fact that the porous knurdle 24 has a virtually closed end portion 28, the blowing gas applied by the tuyere pipe 16 exits, as best it can, through the plurality of porous openings 26 formed therein, thus producing multiple high velocity jets of gas injection into the bath and against the surface 22 of refractory 20, which results in a high rate of erosion damage. In a like manner, the solid knurdle 30, shown in FIG. 7, closes off the tip 14 of tuyere pipe 16 and prevents any blowing of the bath. The knurdle 30 is formed when the temperature of the bath and the adjacent chemical energy in the metal system are even at a lower level than that which creates the porous knurdle 24.

Not only do FIGS. 5–8 illustrate various forms of knurdles, but also illustrate various relative rates of wear between the tuyere pipe and the basic refractory adjacent to the tuyere port. That is, in FIGS. 5 and 7, the refractory rate of wear is substantially equal to or matches that of the tuyere pipe rate of wear. In the illustration shown in FIG. 6, the rate of wear of the inner surface 22 of refractory 20 is substantially greater than the rate of wear of the tip 14 of the tuyere pipe 16. However, in the illustration shown in FIG. 8, the tuyere pipe 16 has been burned back within the tuyere port substantially past the inner surface 22 of the refractory 20. Thus, the knurdle 11, which is substantially the same in configuration as knurdle 10, extends within the tuyere port 18 and is in direct contact with a substantial portion of the refractory 20. It is this problem of burn-back and the resulting knurdle formed within the tuyere port which creates the problem of refractory deterioration during punching or the mechanical clearing of the knurdle from the tuyere tip.

That is, the pyro-metallurgist in the non-ferrous industry has opted to mechanically clear the various knurdles during the blowing operation by punching, and after each heat by preping or reaming the tuyere pipe. Accordingly, the state of the knurdle and the degree of the tuyere pipe burn-back, relative to the basic refractory tuyere port, are important considerations which must be controlled during the total blowing process. It will be understood, of course, that conditions vary during the blowing process which will create different forms of knurdles and degrees of burn-back, as the process progresses. That is, within those excessive temperature periods during the blow, there is insufficient heat removal capacity and diffusivity to form a knurdle. In view of the fact that the ideal knurdle form of FIG. 5 functions to displace the developing heat flux away from the nozzle and the refractory, when no knurdle is formed the tuyere pipe loses such protection and cooling is generally insufficient to compensate for such excessive heat. Thus, the tuyere is alloyed or heated to excessive temperatures which result in abnormal tuyere pipe wear or burn-back, such as shown in FIG. 8. When the knurdle has a shape similar to that shown in FIG. 5, the clearing of the knurdle during punching or preping results in little or no mechanical damage to the basic refractory tuyere port. However, when attempting to clear a knurdle having the shape shown in FIG. 6 or 7, and when the pipe is burned back as shown in FIG. 8, it has been found that severe damage results in the basic refractory as well as the refractory tuyere port.

The mechanism causing the gross or excessive mechanical damage to the refractory of a metallurgical tank adjacent the tuyere line, is the result of the knurdle control process, the tuyere pipe burn-back and the mechanical knurdle clearing practice employed. However, it is the tuyere pipe burn-back, which is the cause of the mechanical damage, whereas the typical refractory failure experienced by the mechanical clearing of the knurdle, is the observed effect.

By utilizing a tuyere pipe with proper thermal conductivity and heat diffusivity along with external water cooling, in a copper system, it is possible to provide a range of control of heat extraction to match the process temperature variability during the blowing, so as to provide knurdle size control and prevent tuyere pipe burn-back, such as by utilizing a tuyere embodying the concept of the present invention as shown in FIGS. 1–4.

Referring to FIG. 1, a tuyere assembly 40 is shown positioned within a wall 42 of a metallurgical furnace 44. The tuyere assembly 40 includes a housing 46 and tuyere pipe 16. Although the housing 46 is shown being positioned within a wall 42 of the metallurgical furnace 44, the housing may be cooperably positioned exteriorly of the furnace wall. The tuyere pipe 16 is shown as being positioned within a tuyere port 18 formed in tuyere block 19, with the tuyere tip 14 extending within the furnace interiorly of the inner surface 22 of the refractory 20.

Figure 2:
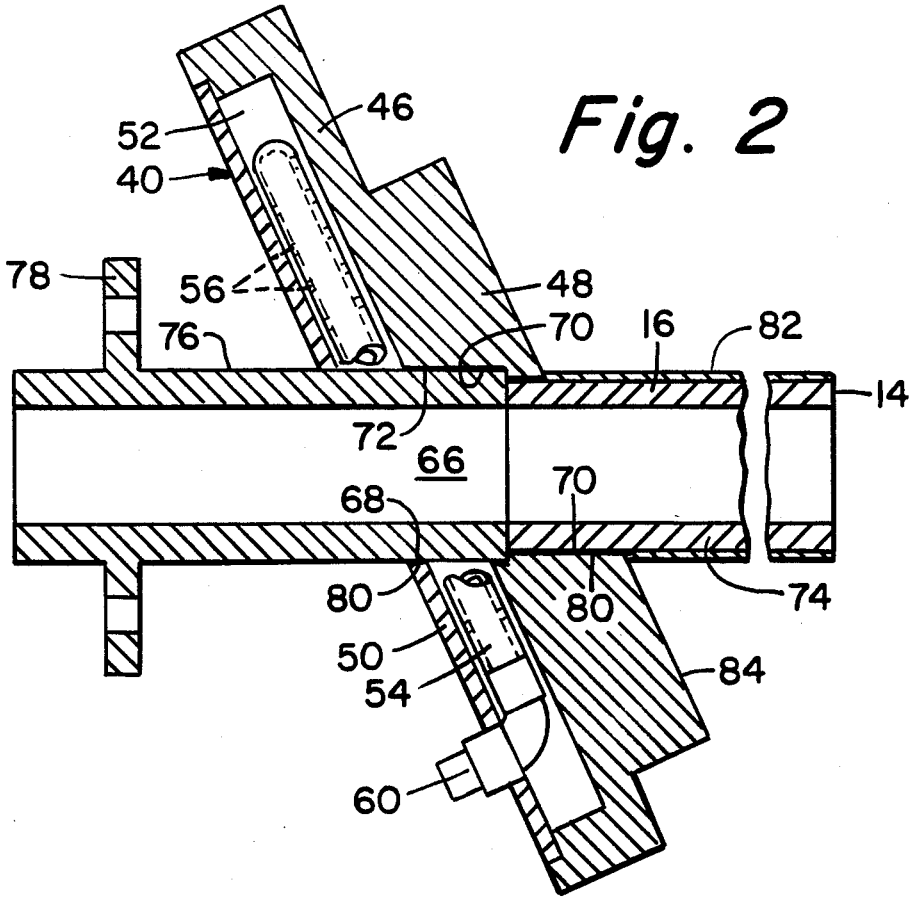
FIG. 2 is an elevational view in section of an embodiment of the metallurgical tuyere forming the present invention.
Figure 3:
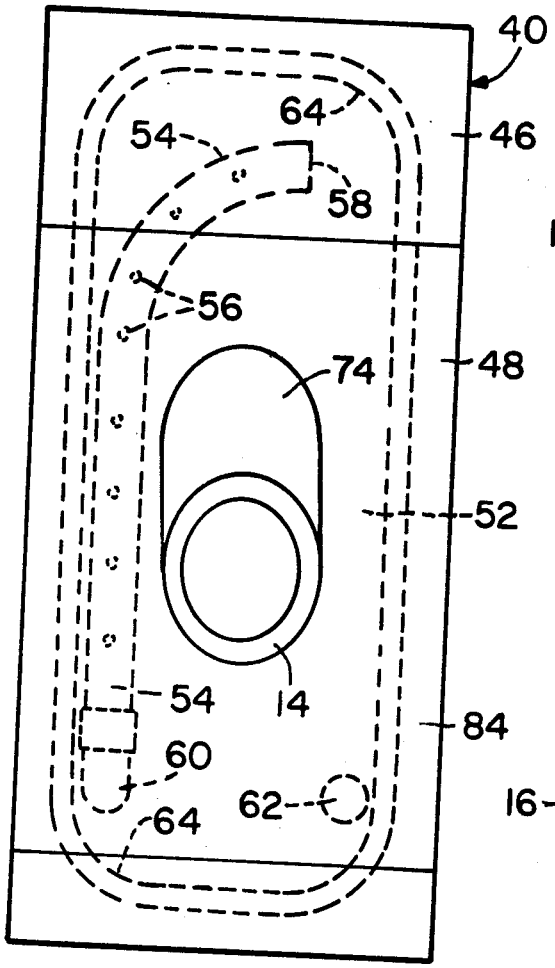
FIG. 3 is a front or inside view of the tuyere shown in FIG. 2.
Figure 4:
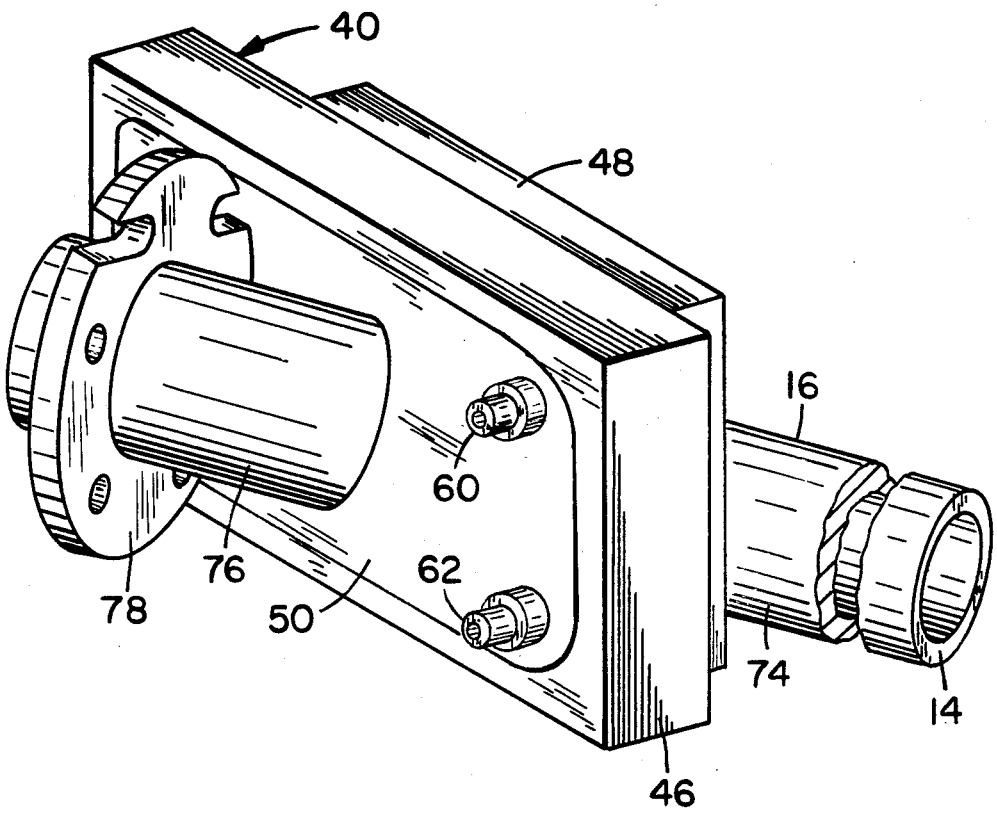
FIG. 4 is a perspective view of the tuyere shown in FIG. 2.

The tuyere assembly 40 is more clearly shown in FIGS. 2, 3 and 4. The housing 46 includes an inner solid heat-sink wall 48 and an outer plate wall 50, forming a cooling chamber 52 therebetween within the housing 46. The cooling chamber is provided with an open ended cooling tube 54, having a plurality of openings 56 along its extent, and an open outer end 58. An inlet pipe 60 extends through outer plate 50 and connects with an inlet end of cooling tube 54, whereas an outlet pipe 62 communicates with the chamber 52 for discharging the cooling fluid from the chamber. The cooling chamber 52 is provided with rounded corner portions 64 for facilitating the flow of the cooling fluid therein. Although various cooling fluids may be utilized, water cooling is generally preferred.

A passageway 66 extends through housing 46 for accommodating the tuyere pipe 16. The passageway 66 includes a passage 68 through outer plate wall 50 and a passage 70 through inner heat-sink wall 48. The passage 70, formed in inner heat-sink wall 48, is counterbored at 72 from the cooling chamber 52. The tuyere pipe 16 is preferably formed of two tubular portions, including inner tuyere tube portion 74 and outer tuyere tube portion 76. As noted, outer tuyere tube portion 76 extends through outer plate wall 50, through the cooling chamber 52, and within the counterbore 72 of passage 70, whereas inner tuyere tube portion 74 is positioned within passage 70 in thermal abutting relation with outer tuyere tube portion 76. Accordingly, the inner tube portion 74 may be easily removed and replaced upon deterioration due to use. The outer tuyere tube portion 76 may be provided with a connecting flange 78.

The housing 46, including outer plate 50, and the outer tuyere tube portion 76 are preferably formed of electrolytic tough pitch copper, whereas the inner tuyere tube portion 74 is preferably formed of an oxygen free high conductivity copper (OFHC) alloyed with 25 ounces of silver per ton, forming an inner tube portion of copper silver material having a higher thermal conductivity and heat diffusivity than the outer tube portion. The inner and outer tuyere tube portions may be sealed to the housing along passages 68 and 70 by any suitable means such as brazing, electron beam welding or the like 80 so as to provide high thermal conductivity therebetween. In a like manner, the outer plate 50 may be brazed or electron beam welded to the housing body 46. As an alternative, the outer tuyere tube portion 76 may be formed integrally with the housing 46, thereby eliminating the need for counterbored passageway 70 and the brazing 80 along such passageway.

A refractory coating 82 may be applied to the exterior surface of the inner tuyere tube portion 74 extending from the exposed surface 84 of inner wall 48. The refractory coating 82, which is shown greatly enlarged in FIG. 2 for purposes of clarity, may be in the form of a flame-sprayed alumina, or magnesia, zirconates, and chromites or the like, which function to isolate or limit the radial heat flux to the inner tuyere tube portion, thus reducing the magnitude of the tuyere barrel heat diffusivity heat flux. If desired, the exposed surface 84 may also be provided with a similar refractory coating to reduce heat transfer from the tuyere block 19 to the housing 46.

As previously pointed out, it is through the utilization of external fluid cooling in conjunction with a tuyere pipe having relatively high heat diffusivity and thermal conductivity which overcome the problems of knurdle size control and tuyere pipe burn back, and accordingly the physical properties of the materials utilized in the present tuyere assembly are extremely important to obtain the desired results. The following Table I sets forth various materials, their density, thermal conductivity, specific heat and heat diffusivity, to illustrate the diversity in the parameters of such materials and the necessity for utilizing the correct materials:

TABLE I

| Material | Density (lbs/in$^3$) | 32–212° F. Thermal Conductivity (BTU/Ft$^2$/in hr °F.) |
|---|---|---|
| Ingot Iron | 0.284 | 490 |
| Steel, 1020 | 0.284 | 360 |
| Stainless Steel | | |
| Aust. 304 | 0.29 | 113 |
| Mart. 410 | 0.28 | 173 |
| Ferrit. 446 | 0.27 | 143 |
| A Nickel | 0.321 | 420 |
| Inconel X | 0.298 | 102 |
| Brass | 0.306 | 830 |
| Copper, (99.9+%) | 0.322 | 2700 |
| OFHC | 0.323 | 2712 |

| Material | 32–212° F. Specific Heat (BTU/lb °F.) | Heat Diffusivity (in$^2$/Hr) |
|---|---|---|
| Ingot Iron | 0.108 | 110.9 |
| Steel, 1020 | 0.107 | 82.3 |
| Stainless Steel | | |
| Aust. 304 | 0.12 | 22.5 |
| Mart. 410 | 0.11 | 39.0 |
| Ferrit. 446 | 0.12 | 30.6 |
| A Nickel | 0.11 | 82.6 |
| Inconel X | 0.105 | 22.6 |
| Brass | 0.09 | 209.3 |
| Copper, (99.9+ %) | 0.092 | 632.9 |
| OFHC | 0.092 | 633.8 |

It thus can be seen from Table I that there is a vast differential in thermal conductivity and heat diffusivity between brass and copper. Although brass does not effectively function for use as a tuyere pipe in the present invention because of its low thermal conductivity of 830 BTU/Ft$^2$/in. hr. °F. and low heat diffusivity of 209.3 in.$^2$/hr., and electrolytic copper and oxygen free high conductivity copper both provide excellent results in the present tuyere assembly due to their high thermal conductivities and heat diffusivities, it is theorized that any material or alloy having the requisite melting point and a thermal conductivity of at least 2500 BTU/Ft$^2$/in. hr. °F. and a heat diffusivity of at least 500 in.$^2$/hr. will in fact incorporate the requisite parameters to provide the desired heat extraction over a range of control to compensate for variability in the temperature of the molten bath adjacent the tuyere nozzle. Thus, although there is not a vast difference between the thermal conductivities and heat diffusivities of electrolytic copper and OFHC, the inner tuyere tube portion 74 is preferably formed of an OFHC material. In fact, a copper silver alloy containing OFHC with 25 ounces of silver per ton of copper produces a very effective high thermal conductivity and high diffusivity copper silver material for use in the inner tuyere portion 74.

In operation, a plurality of tuyere assemblies 40 are operatively positioned about a metallurgical furnace with inner tuyere tube portion 74 projecting inwardly through a tuyere block into a molten bath portion of the furnace. The rate of flow of the cooling fluid entering the cooling chamber 52 through inlet pipe 60 is controlled by suitable valve means relative to the blowing cycle so as to maintain the desired heat transfer from the tuyere tip 14 through the heat sink 48 and cooling water flowing through the fluid cooled chamber 52. Thus, by controlling the cooling of the tuyere nozzle, by means of the liquid cooling within the tuyere body, functioning through the high heat diffusivity and high thermal conductivity properties employed within the tuyere pipe, it is not only possible to control the rate of burnback of the tuyere pipe so as to substantially conform with the rate of wear of the surrounding refractory, but also it is possible to control the deleterious effects of knurdle formation.

Although I have now disclosed the preferred embodiments of my invention, it will be apparent to those skilled in the art that various changes and modifications may be made thereto without departing from the spirit and scope of the invention as defined in the appended claims.

I claim:

1. A fluid cooled tuyere for use in metallurgical furnaces which comprises:

a housing positionable exteriorly of a refractory wall of a metallurgical furnace;

said housing having a cooling chamber formed therewithin and a solid heat-sink wall extending from adjacent said chamber so as to project inwardly within wall portions of a metallurgical furnace;

means for supplying and circulating cooling fluid through said cooling chamber;

said heat-sink wall forming an inner wall of said housing, and an opposite wall, enclosing a portion of said cooling chamber, forming an outer wall of said housing;

tuyere tube means extending through said cooling chamber and outwardly of both said inner and outer walls of said housing;

and said housing and said tuyere tube means being formed of a material having a thermal conductivity of at least about 2500 BTU/Ft$^2$/in. hr. °F. and a heat diffusivity greater than about 500 in.$^2$/hr.

2. A fluid cooled tuyere as defined in claim 1, wherein said means for supplying and circulating cooling fluid through said cooling chamber communicates with said outer wall, and includes an open-ended cooling tube positioned within said chamber having a plurality of opposed openings formed along its length.

3. A fluid cooled tuyere as defined in claim 2, wherein said cooling chamber includes a plurality of rounded corner portions for facilitating fluid flow therein, and said supplying and circulating means supplies a continuous flow of water through said cooling chamber.

4. A fluid cooled tuyere as defined in claim 1, wherein said tuyere tube means includes an outer tuyere tube portion and an inner tuyere tube portion connected together interiorly of said housing, said outer tuyere tube portion extends outwardly through said outer wall, and said inner tuyere tube portion extends inwardly of the furnace from said inner wall.

5. A fluid cooled tuyere as defined in claim 4, wherein said inner tuyere tube portion is formed of a material having higher thermal conductivity and heat diffusivity than said outer tuyere tube portion.

6. A fluid cooled tuyere as defined in claim 4, wherein said outer tuyere tube portion is formed of an electrolytic tough pitch copper material integral with said housing, and said inner tuyere tube portion is formed of an oxygen free high conductivity copper material conductively secured to said housing.

7. A fluid cooled tuyere as defined in claim 1 wherein said tuyere tube means is sealed to said heat-sink wall for facilitating thermal conductivity therebetween.

8. A fluid cooled tuyere as defined in claim 1 including passage means formed through said inner and outer walls of said housing, said inner wall being counterbored from said cooling chamber; and said tuyere tube means includes an outer tube portion extending through the passage in said outer wall, through said cooling chamber, and into said counterbore in said inner wall; and an inner tube portion extending within the passage formed in said inner wall and abutting an end portion of said outer tube portion.

9. A fluid cooled tuyere as defined in claim 8 wherein said inner tube portion is removably brazed within the passage formed in said inner wall so as to easily be removed and replaced upon deterioration due to use.

10. A fluid cooled tuyere as defined in claim 8 wherein said outer tube portion is formed of an electrolytic copper and said inner tube portion is formed of a copper silver material having higher thermal conductivity and heat diffusivity than said outer tube portion.

11. A fluid cooled tuyere as defined in claim 1 including a refractory coating about the tuyere tube means extending outwardly from said inner wall of said housing for radially insulating the same and inhibiting intertuyere heat fluxes and thermal gradient fluxes from the surrounding refractory material of the furnace.

12. A fluid-cooled tuyere assembly for use with a metallurgical furnace which comprises:

said tuyere assembly including a housing having a tuyere pipe extending therethrough, said housing having a fluid-cooled chamber therewithin and being positionable with respect to an outside wall of a metallurgical furnace so that such fluid cooling is exterior of a refractory wall of such furnace, said housing having an inner heat-sink wall communicating with one side of said fluid-cooled chamber and an outer wall communicating with an opposite side of said chamber, said tuyere pipe extending through both said inner and outer walls of said housing and said fluid-cooled chamber so as to be directly cooled by both said heat-sink wall and said fluid cooled chamber, means for supplying and circulating fluid cooling through said cooling chamber, and said tuyere pipe being formed of materials wherein the thermal conductivity thereof is at least about 2500 BTU/Ft$^2$ in. hr. °F. and the heat diffusivity thereof is greater than about 500 in.$^2$/hr.

13. A fluid-cooled tuyere assembly as defined in claim 12 wherein said tuyere pipe comprises an inner tuyere tube portion and an outer tuyere tube portion, and said tuyere pipe being positioned within axially aligned passages extending through said housing, with said inner tuyere tube portion being positioned within said inner heat sink wall and extending away from a side thereof opposite the side communicating with said fluid-cooled chamber, and said outer tuyere tube portion being positioned within a portion of said inner heat-sink wall and extending through said fluid-cooled chamber and said outer wall.

14. A fluid-cooled tuyere assembly as defined in claim 13 including means for sealably connecting said inner and outer tuyere tube portions to said housing with high thermal conductivity therebetween so as to facilitate heat transfer from the tuyere pipe to the housing.

15. A fluid-cooled tuyere assembly as defined in claim 14 wherein said inner tuyere tube portion is formed of a material having higher thermal conductivity and heat diffusivity than said outer tuyere tube portion, and said inner tuyere tube portion is removably brazed within the passage in said inner heat-sink wall so as to be easily removed and replaced upon deterioriation due to use.

16. A fluid-cooled tuyere assembly as defined in claim 12 wherein said tuyere pipe includes an inner tuyere tube portion and an outer tuyere tube portion, said inner tuyere tube portion being positioned within a passage formed in said inner wall and extending therefrom away from said cooling chamber, said inner tuyere tube portion being removably secured to said housing to promote high thermal conductivity therebetween, and said inner tuyere tube portion being formed of a copper silver material.

17. A fluid-cooled tuyere assembly as defined in claim 12 wherein said tuyere pipe is formed of an inner tuyere tube portion and an outer tuyere tube portion, and said outer tuyere tube portion is formed integrally with said housing and extends through said fluid-cooled chamber and outwardly through said outer wall, and means removably securing said inner tuyere tube portion within said inner heat-sink wall for facilitating high thermal conductivity therebetween and for facilitating the removal and replacement thereof upon deterioration due to use.

18. A fluid-cooled tuyere assembly as defined in claim 12 wherein said tuyere pipe includes a portion extending from said inner heat-sink wall toward an interior portion of the metallurgical furnace, and coating means on the outer surface of such portion of the tuyere pipe for limiting radial heat flux thereto.

19. A method of controlling tuyere pipe burn-back and adjacent refractory deterioration in a metallurgical furnace which comprises:

inserting a tuyere pipe through a tuyere port formed in a refractory block positioned adjacent a wall of a metallurgical furnace so that an outer end of said tuyere pipe extends outwardly of the furnace wall, and an inner end of said tuyere pipe extends inwardly of the refractory block within a molten bath portion of the furnace, providing a heat-sink about a portion of said tuyere pipe extending exteriorly of said refractory block, applying liquid cooling solely exteriorly of said refractory block to both said heat sink and a portion of said tuyere pipe, forming said tuyere pipe from a material having a thermal conductivity of at least 2500 BTU/Ft$^2$/in. hr. °F. and a heat diffusivity at least about 500 in.$^2$/hr. so as to efficiently transfer heat from the inner end of said tuyere pipe to said heat sink and cooling liquid, and controlling the rate of liquid cooling applied so as to control the amount of heat extraction from the inner end of said tuyere pipe so as to match the process temperature variability of the molten bath adjacent said inner end and thereby control tuyere pipe burn-back and adjacent refractory deterioriation.

20. A method of controlling tuyere pipe burn-back and adjacent refractory deterioriation in a metallurgical furnace as defined in claim 19 including the steps of forming an inner portion of said tuyere pipe of copper silver and limiting the amount of radial heat flux to the tuyere pipe by refractory coating exterior surface portions thereof.

* * * * *